US006997010B2

(12) United States Patent
Suzuki et al.

(10) Patent No.: US 6,997,010 B2
(45) Date of Patent: Feb. 14, 2006

(54) REGENERATIVE HEAT PUMP SYSTEM

(75) Inventors: Motohiro Suzuki, Osaka (JP); Tetsuo Terashima, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/117,141

(22) Filed: Apr. 28, 2005

(65) Prior Publication Data

US 2005/0188718 A1 Sep. 1, 2005

Related U.S. Application Data

(63) Continuation of application No. PCT/JP04/08376, filed on Jun. 9, 2004.

(30) Foreign Application Priority Data

Jun. 9, 2003 (JP) ..... 2003-163303
Mar. 12, 2004 (JP) ..... 2004-071781

(51) Int. Cl.
*F25B 45/00* (2006.01)

(52) U.S. Cl. ..... 62/434; 62/324.6

(58) Field of Classification Search ..... 62/335, 62/430, 434, 324.6
See application file for complete search history.

(56) References Cited

U.S. PATENT DOCUMENTS 5,372,011 A * 12/1994 O'Neal ..... 62/93
5,381,671 A * 1/1995 Saito et al. ..... 62/430
6,148,634 A * 11/2000 Sherwood ..... 62/434
6,470,679 B1 * 10/2002 Ertle ..... 60/512
6,679,321 B1 * 1/2004 Jin ..... 165/236

FOREIGN PATENT DOCUMENTS

| | | | |
|---|---|---|---|
| JP | 03-061108 | B2 | 9/1991 |
| JP | 05-288425 | A | 11/1993 |
| JP | 07-006708 | B2 | 1/1995 |
| JP | 11-193958 | | 7/1999 |
| JP | 2003-004316 | A | 1/2003 |

OTHER PUBLICATIONS

International Search Report for PCT/JP2004/008376 dated Sep. 7, 2004.

* cited by examiner

*Primary Examiner*—Melvin Jones
(74) *Attorney, Agent, or Firm*—RatnerPrestia

(57) ABSTRACT

The present invention provides a regenerative heat pump system including a heat pump cycle, first storage vessel for storing a heat storage material, heat exchange device between first refrigerant and heat storage material for heating and decomposing the heat storage material by heat from a refrigerant, and heat exchange device between second refrigerant and an other heat storage material for transferring heat from the separated heat storage material to the refrigerant. The system also includes second storage vessel for storing the decomposed heat storage material, and heat generating device for generating heat by recombining the heat storage material stored in the second storage vessel and for heating a heating medium. The heat exchange device between the first refrigerant and the heat storage material is also used as a radiator of the heat pump cycle, and the heat exchange device between second refrigerant and the other heat storage material is also used as at least a part of an evaporator of the heat pump cycle.

22 Claims, 10 Drawing Sheets

REGENERATIVE HEAT PUMP SYSTEM

This application is a continuation of International Application PCT/JP2004/008376, filed Jun. 9, 2004, the contents of which are incorporated herein by reference.

BACKGROUND OF THE INVENTION

1. Field of the Invention

The present invention relates to a heat pump system having a small-size heat storage section for storing heat by decomposing or separating a heat storage material by heating.

2. Related Art of the Invention

A conventional heat pump system having a heat storage section (for example, Japanese Patent Laid-Open No. 11-193958) utilizes a thermal output from a high-temperature and high-pressure refrigerant discharged from a compressor, and stores a large quantity of hot water in a hot water storage tank while repeating a cycle for raising temperature by circulating hot water in the hot water storage tank.

Also, a regenerative heat pump system (for example, Japanese Patent Laid-Open No. 5-288425), which is a combination of a regenerative heat pump and a compression heat pump, utilizes a thermal output from a refrigerant as heat for reaction, and chemically stores heat by storing a substance generated by this reaction.

The entire disclosures of Japanese Patent Laid-Open No. 11-193958 and Japanese Patent Laid-Open No. 5-288425 are incorporated herein by reference in their entirety.

In the above-described conventional heat pump system having a heat storage section, a large-capacity hot water storage tank is required. Therefore, there arise problems regarding installation and workability such as installation space, weight of hot water storage tank, and load-carrying capacity of installation portion.

Also, in the conventional regenerative heat pump system, the thermal output from a refrigerant having a temperature lower than the reaction temperature is not utilized effectively, which poses a problem in that it is difficult to secure high COP.

Also, in the case where a gaseous product is generated in the reaction, it is necessary to liquefy the product or to form a compound with other substances or an adsorbent in order to reduce the storage space. In this case, there arises a problem in that the generated heat of reaction cannot be recovered sufficiently.

Also, there arises a problem in that when heat is taken out by utilizing exothermic reaction, the thermal output cannot be provided in a moment because of the heat capacity of a reactor vessel. Further, there arises a problem in that power is consumed to supply a reactant at this time, or heat cannot be supplied with high energy efficiency.

Further, in the case where a reactant for carrying out exothermic reaction is absent because of high heat demands, there arises a problem in that the thermal output cannot be provided.

SUMMARY OF THE INVENTION

An object of the present invention is to provide a regenerative heat pump system capable of solving the above-described problems with the conventional heat pump system.

The $1^{st}$ aspect of the present invention is a regenerative heat pump system comprising:

a heat pump cycle having a compressor, a radiator for a refrigerant, an expansion valve, a evaporator for the refrigerant, and a refrigerant flow path;

first storage means of storing a heat storage material;

heat exchange means between first refrigerant and heat storage material of heating said heat storage material by heat transferred from said refrigerant so that said heat storage material is decomposed or some thereof is separated;

heat exchange means between second refrigerant and heat storage material of transferring heat from at least one kind of said decomposed or separated heat storage material to said refrigerant;

second storage means of storing at least one kind of said decomposed or separated heat storage material; and heat generating means of generating heat to heat a heating medium by recombining said heat storage material having been stored in said second storage means, wherein said heat exchange means between first refrigerant and heat storage material is also used as said radiator of the heat pump cycle, and heat exchange means between second refrigerant and heat storage material is also used as at least a part of said evaporator of the heat pump cycle.

Further, the $2^{nd}$ aspect of the present invention is the regenerative heat pump system according to the $1^{st}$ aspect of the present invention, wherein said first storage means is integrated with said heat exchange means between first refrigerant and heat storage material and said heat generating means.

Furthermore, the $3^{rd}$ aspect of the present invention is the regenerative heat pump system according to the $1^{st}$ aspect of the present invention, wherein said second storage means is integrated with said heat exchange means between second refrigerant and heat storage material.

Furthermore, the $4^{th}$ aspect of the present invention is the regenerative heat pump system according to the $3^{rd}$ aspect of the present invention, wherein said second storage means has a storage material of occluding or adsorbing at least one kind of gas of said decomposed or separated heat storage material, and at the time of heat storage operation, said gas is stored in said second storage means by forming a compound or a complex with said storage material, and the heat generated at the time of formation of said complex is transferred to said refrigerant.

Furthermore, the $5^{th}$ aspect of the present invention is the regenerative heat pump system according to the $1^{st}$ aspect of the present invention, wherein at the time of heat storage operation, at least one kind of gas of said decomposed or separated heat storage material is cooled by said heat exchange means between second refrigerant and heat storage material, and stored in said second storage means as a liquid.

Furthermore, the $6^{th}$ aspect of the present invention is the regenerative heat pump system according to the $5^{th}$ aspect of the present invention, wherein said gas is taken as a first gas;

said regenerative heat pump system further comprises a third storage means having a storage material of occluding or adsorbing a second gas generated by the decomposition of said heat storage material, other than said first gas; and at the time of heat storage operation, said second gas is stored in said third storage means by forming a compound or a complex with said storage material.

Furthermore, the $7^{th}$ aspect of the present invention is the regenerative heat pump system according to the $1^{st}$ aspect of the present invention, wherein said second storage means has a storage material of occluding or adsorbing at least one kind of gas of said separated heat storage material;

at the time of heat storage operation, said gas is stored in said second storage means by forming a compound or a complex with said storage material.

Furthermore, the $8^{th}$ aspect of the present invention is the regenerative heat pump system according to the $5^{th}$ aspect of the present invention, wherein said storage material is water and water adsorbing material; and said gas is water vapor.

Furthermore, the $9^{th}$ aspect of the present invention is the regenerative heat pump system according to the $6^{th}$ aspect of the present invention, wherein said heat storage material is 2-propanol;

said first gas is acetone; and said second gas is hydrogen.

Furthermore, the $10^{th}$ aspect of the present invention is the regenerative heat pump system according to the $7^{th}$ aspect of the present invention, wherein said heat storage material is a hydrogen or a hydrogen occluding material of occluding hydrogen; and said gas is hydrogen.

Furthermore, the $11^{th}$ aspect of the present invention is the regenerative heat pump system according to the $1^{st}$ aspect of the present invention, wherein said heat exchange means between second refrigerant and heat storage material is arranged on the most upstream side of said evaporator of the cycle.

Furthermore, the $12^{th}$ aspect of the present invention is the regenerative heat pump system according to the $1^{st}$ aspect of the present invention, wherein said regenerative heat pump system further comprises heat recovery means of recovering heat from the refrigerant flowing between said radiator for the refrigerant and said expansion valve, and of transferring heat to the refrigerant flowing between said cooling means and said compressor.

Furthermore, the $13^{th}$ aspect of the present invention is the regenerative heat pump system according to the $2^{nd}$ aspect of the present invention, wherein said regenerative heat pump system further comprises a heating medium flow path in which said heating medium flows;

said heat exchange means between first refrigerant and heat storage material has a plurality of heat transfer fins provided on the outside surface of said refrigerant flow path;

said heat generating means has a plurality of heat transfer fins provided on the outside surface of said heating medium flow path, and said heat storage material is packed between said plurality of heat transfer fins provided on the outside surfaces of said refrigerant flow path and said heating medium flow path.

Furthermore, the $14^{th}$ aspect of the present invention is the regenerative heat pump system according to the $13^{th}$ aspect of the present invention, wherein said heat storage material is of a spherical or pellet shape; and said first storage means has a high thermal conductivity material, which has higher thermal conductivity and a smaller diameter than said heat storage material and is mixed with said heat storage material, between said plurality of heat transfer fins.

Furthermore, the $15^{th}$ aspect of the present invention is the regenerative heat pump system according to the $13^{th}$ aspect of the present invention, wherein said first storage means has a highly heat insulating material having lower thermal conductivity than said heat storage material on the outside surface; and at the time of heat utilization operation, said heating medium is heated by utilizing sensible heat that said heat storage material has.

Furthermore, the $16^{th}$ aspect of the present invention is the regenerative heat pump system according to the $15^{th}$ aspect of the present invention, wherein the operation of said heat pump cycle is performed continuously even after the finish of heat storage operation to raise the temperature of said heat storage material.

Furthermore, the $17^{th}$ aspect of the present invention is the regenerative heat pump system according to the $13^{th}$ aspect of the present invention, wherein at least some of said plurality of heat transfer fins provided on the outside surface of said refrigerant flow path and said plurality of heat transfer fins provided on the outside surface of said heating medium flow path are common to each other.

Furthermore, the $18^{th}$ aspect of the present invention is the regenerative heat pump system according to the $17^{th}$ aspect of the present invention, wherein at the time of start of heat utilization operation, heat released from said radiator is directly transferred to said heating medium via said heat transfer fins by performing the operation of said heat pump cycle.

Furthermore, the $19^{th}$ aspect of the present invention is the regenerative heat pump system according to the $17^{th}$ aspect of the present invention, wherein at the time of heat utilization operation, the operation of said heat pump cycle is performed by detecting that one kind of said decomposed or separated heat storage material, which is stored in said second storage means, becomes absent, so as to cause the heat released from said radiator to be directly transferred to said heating medium via said heat transfer fins.

Furthermore, the $20^{th}$ aspect of the present invention is the regenerative heat pump system according to the $1^{st}$ aspect of the present invention, wherein said second storage means has heating means using solar heat, atmospheric heat, exhaust heat of city water or bath, or heat released from said heat pump cycle as a heat source; and at the time of heat utilization operation, one kind of said decomposed or separated heat storage material, which is stored in said second storage means, is heated and supplied to said heat generating means.

Furthermore, the $21^{st}$ aspect of the present invention is the regenerative heat pump system according to the $1^{st}$ aspect of the present invention, wherein said second storage means has heating means using solar heat, atmospheric heat, exhaust heat of city water or bath, or heat released from said cycle as a heat source;

at the time of finish of heat storage operation, said second storage means is heated so that heat is stored in one kind of said decomposed or separated heat storage material, which is stored in said second storage means, as sensible heat; and at the time of heat utilization operation, one kind of said heat storage material stored in said second storage means is supplied to said heat generating means with said sensible heat being used as a heat source.

Furthermore, the $22^{nd}$ aspect of the present invention is the regenerative heat pump system according to the $21^{st}$ aspect of the present invention, wherein electric power in a time zone in which power rates are low is used for the operation of said cycle.

According to the present invention, by storing heat output from the heat pump by a reversible reaction, a high heat storage density can be realized as compared with the conventional heat storage density of 310 kJ/kg (when the temperature is raised to 75° C.) obtained by the sensible heat of water. Therefore, the heat storage system can be made small in size, and hence a compact regenerative heat pump system having a high installation property can be provided.

Also, by recovering heat from the refrigerant having a temperature lower than the reaction temperature and by transferring heat to the refrigerant prior to flowing into the compressor, the refrigerant having a temperature lower than the reaction temperature is also utilized effectively. Therefore, high COP can be realized, and hence a regenerative heat pump system that achieves energy saving and therefore has high economic efficiency can be provided.

Also, by selecting a reaction system capable of carrying out elimination reaction and adsorption or occlusion reaction in one adsorbent or occluding alloy storage vessel, the heat storage system can be made simple in construction and small in size. Therefore, a compact regenerative heat pump system with a good installability can be provided.

Also, by condensing the gas generated at the time of decomposition reaction and storing it as a liquid, or by forming a solid compound or adsorbent at the time of storage, the capacity required for heat storage is reduced. Also, by utilizing the heat of condensation as heat for evaporating the refrigerant, the refrigerant evaporator for carrying out heat recovery from the atmospheric air is made small in size, and also the capacity of a fan for supplying the atmospheric air at this time is reduced, so that noise can also be reduced. Therefore, a regenerative heat pump system that is quiet and suitable for residential environments can be provided.

Also, by providing the cooling means for recovering heat of condensation on the upstream side of the refrigerant evaporator, the condensation of gas is accelerated due to the low temperature, so that the endothermic reaction in the heating means is accelerated. Therefore, a regenerative heat pump system having a further improved heat storage density can be provided.

Also, by utilizing energy from the outside of the system, such as solar heat and atmospheric heat, as heat sources for the heating means for evaporating the stored liquid or the heat means that performs decomposition of solid compound or heating utilized for the elimination reaction from the adsorbent, high energy efficiency can be realized. Therefore, a regenerative heat pump system that achieves energy saving and therefore has high economic efficiency can be provided.

Also, by utilizing the sensible heat in the storage vessel heated by the output due to the heat pump operation as heat sources for the heating means for evaporating the stored liquid or the heat means that performs decomposition of solid compound or heating utilized for the elimination reaction from the adsorbent, the operation can be performed without a driving section in the heat utilization mode. Therefore, a regenerative heat pump system that is quiet and suitable for residential environments can be provided. Also, by performing the heat pump operation in a time zone in which power rates are low (the middle of the night in the present Japanese power system), a regenerative heat pump system that is superior in terms of economy can be provided.

Also, by heating the heating medium by utilizing the sensible heat in the adsorbent storage vessel further heated by the exothermic reaction or the output from the heat pump immediately after the start of heat utilization mode, the supply of heat can be started in a moment. Therefore, a regenerative heat pump system that provides great convenience of supplying hot water in a moment can be provided.

Further, by performing the operation under a reduced pressure lower than the atmospheric pressure, the sensible heat of heat storage material can be utilized as a heating source of the heating means for evaporating the stored liquid or the heat means that performs decomposition of solid compound or heating utilized for the elimination reaction from the adsorbent, to the outside air temperature level. Therefore, a regenerative heat pump system capable of effectively using low-temperature exhaust heat can be provided.

Also, by the configuration capable of directly transferring heat from the refrigerant to the heating medium, heating can be started in a moment in the heat utilization mode. Also, even in the case where heat demands are high and exceed the quantity of heat stored by the reversible reaction, the quantity of heat can be secured. Therefore, a regenerative heat pump system capable of supplying heat stably can be provided.

DESCRIPTION OF SYMBOLS

Figure 1:
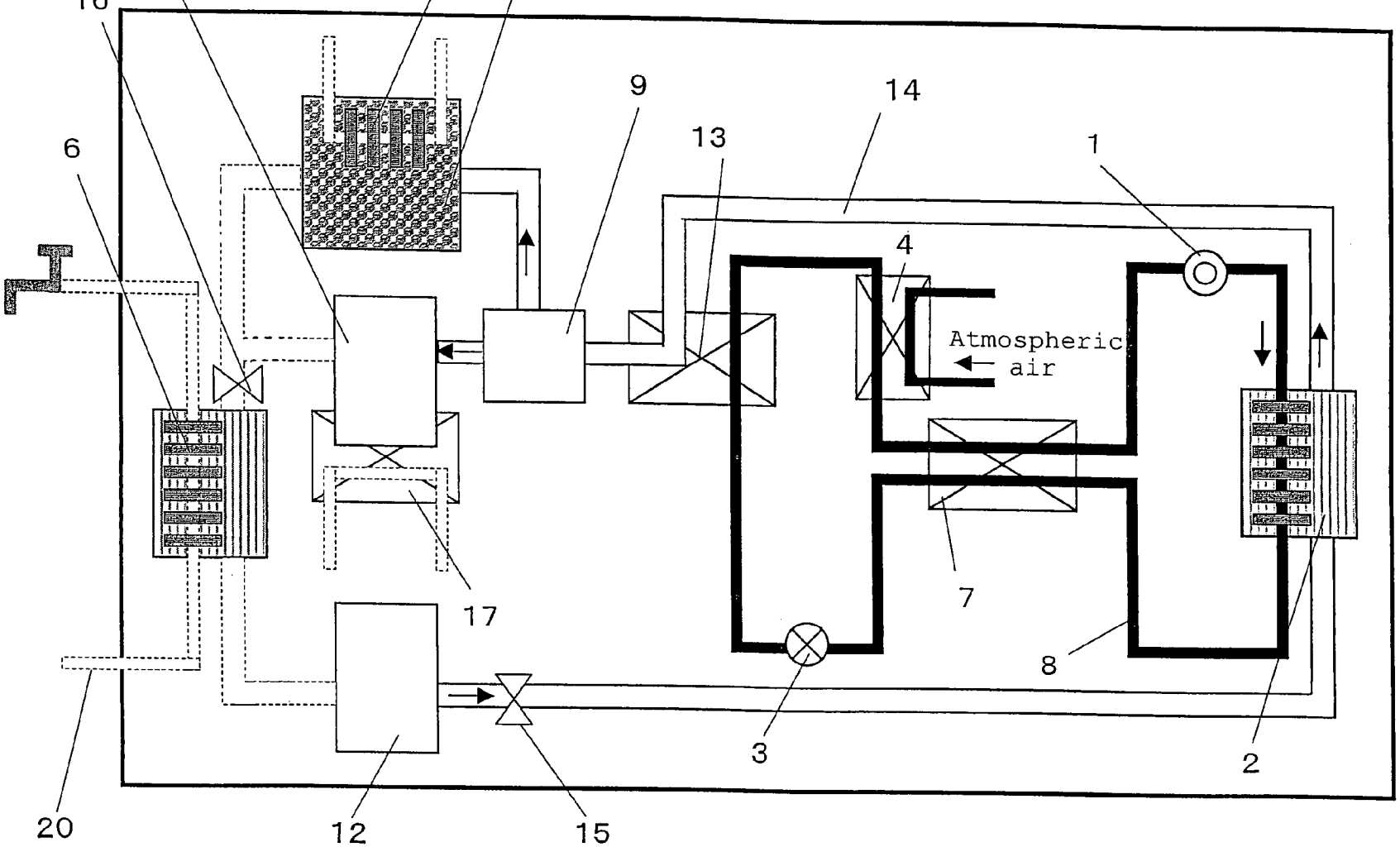
FIG. 1 is a schematic view showing an operation state in a heat storage mode of a regenerative heat pump system in accordance with a first embodiment of the present invention.

1 refrigerant compressor
2 heating means
3 refrigerant expansion valve
4 refrigerant evaporator
5 adsorbent storage vessel
6 heat generating means
7 heat recovery means
8 refrigerant flow path
9 gas-liquid separator

10 acetone storage vessel
11 hydrogen storage vessel
12 2-propanol storage vessel
13 cooling means
14 heat storage material flow path
15 valve A
16 valve B
17 heating means B
18 heating means C
19 heat generating means
20 heating medium flow path
21 hydrogen absorbing alloy storage vessel
22 water storage vessel
23 heat exchange means A between refrigerant and water
24 heat exchange means B between refrigerant and water
25 pump
26 water flow path
27 reactor heat insulating section
28 heat exchange means between refrigerant and heating medium
29 heat exchange means between refrigerant and reactor
30 silica gel
31 heat transfer accelerating fiber
32 heat transfer fin

PREFERRED EMBODIMENTS OF THE INVENTION

Embodiments of the present invention will now be described with reference to the accompanying drawings.

(First Embodiment)

First, a first embodiment of the present invention will be described.

Figure 2:
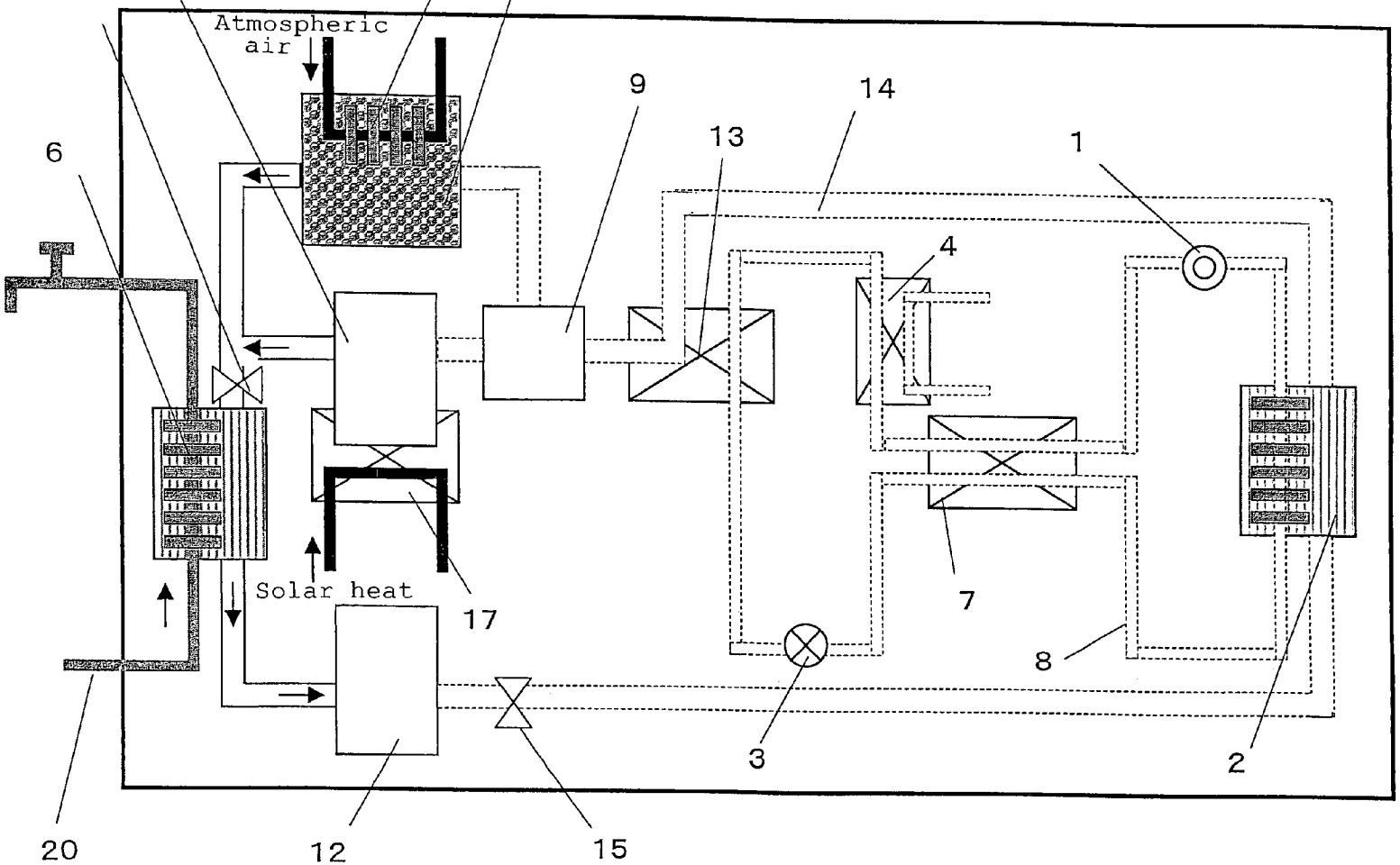
FIG. 2 is a schematic view showing an operation state in a heat utilization mode of a regenerative heat pump system in accordance with a first embodiment of the present invention.

FIGS. 1 and 2 are schematic views showing operation states in a heat storage mode and a heat utilization mode, respectively, of a regenerative heat pump system in accordance with a first embodiment of the present invention. A regenerative heat pump system in the first embodiment includes heat generating means 6, a gas-liquid separator 9, an acetone storage vessel 10, a hydrogen storage vessel 11, a 2-propanol storage vessel 12, cooling means 13, a heat storage material flow path 14, a valve A 15, a valve B 16, heating means B 17, heating means C 18, a heating medium flow path 20, and a heat pump cycle. Also, the heat pump cycle is made up of a refrigerant compressor 1, heating means A 2 acting as a refrigerant condenser, a refrigerant expansion valve 3, a refrigerant evaporator 4 that absorbs heat from the atmospheric air to perform an evaporating function, heat recovery means 7, and a refrigerant flow path 8.

First, referring to FIG. 1, the operation in a heat storage mode of the regenerative heat pump system in accordance with a first embodiment will be explained. When the heat storage mode is started, the valve A 15 is opened, so that 2-propanol stored in the 2-propanol storage vessel 12, which is one example of first storage means of the present invention, flows into the heating means A 2. At the same time, the operation of heat pump is started. After a refrigerant is evaporated by the heat recovered from the atmospheric air in the refrigerant evaporator 4, the temperature and pressure of the evaporated refrigerant are increased by the refrigerant compressor 1, and heat is transferred from the refrigerant, the temperature and pressure of which have been increased, by the heating means A 2. The transferred heat is used for decomposition reaction using 2-propanol as a raw material. This decomposition reaction is carried out at a temperature of about 80° C. The heating means A2 is one example of heat exchange means between first refrigerant and heat storage material that is also used as a radiator of the heat pump cycle of the present invention.

Also, the refrigerant heated to about 80° C. after passing through the heating means A 2 carries out heat exchange, in the heat recovery means 7, with the refrigerant that is going to flow into the refrigerant compressor 1, and, after being cooled to about 30° C., flows into the refrigerant expansion valve 3, thereby being turned into a liquid having a temperature of approximately (atmospheric temperature −5)° C. The temperature of (atmospheric temperature −5)° C. means a temperature lower than the atmospheric temperature by about 5° C.

Further, acetone and hydrogen yielded by the decomposition reaction in the heating means A 2 are discharged from the heating means A 2 as gases. Subsequently, in the cooling means 13, heat exchange is carried out between acetone and the refrigerant and between hydrogen and the refrigerant. Of acetone and hydrogen, acetone having a boiling point of 56° C. condenses. Further, in the gas-liquid separator 9, hydrogen of a gaseous form and acetone of a liquid form are separated from each other. The hydrogen forms a metal hydroxide in the hydrogen storage vessel 11 filled with a hydrogen absorbing alloy, and is stored. On the other hand, the acetone is stored in the acetone storage vessel 10 as a liquid. The cooling means 13 is one example of heat exchange means between second refrigerant and heat storage material that is also used as at least a part of the evaporator of the heat pump cycle of the present invention. Also, the acetone storage vessel 10 is one example of second storage means of the present invention, and the hydrogen storage vessel 11 is one example of third storage means of the present invention.

Next, referring to FIG. 2, the operation in a heat utilization mode of the regenerative heat pump system in accordance with the first embodiment will be explained. When the heat utilization mode is started, the acetone stored in the acetone storage vessel 10 is heated by the heating means B 17 utilizing solar heat as a heat source, and evaporate. Also, the hydrogen stored in the hydrogen storage vessel 11 is heated by the heating means C 18 utilizing atmospheric heat as a heat source, and dehydrogenation reaction takes place. At this time, the valve B 16 is open, so that the acetone and hydrogen flow into the heat generating means 6. In the heat generating means 6, exothermic reaction takes place with acetone and hydrogen being used as raw materials. The water flowing in the heating medium flow path 20 is heated to a temperature of about 90° C. in the heat generating means 6.

By storing heat output from the heat pump by the reversible reaction as described above, a heat storage density as high as 1300 kJ/kg (2-propanol) can be realized as compared with the conventional heat storage density of 310 kJ/kg (when the temperature is raised to 75° C.) obtained by the sensible heat of water. Therefore, the heat storage system can be made small in size.

Also, by providing the heat recovery means 7 that carries out heat exchange between the refrigerant having a temperature lower than the reaction temperature and the refrigerant that is going to flow into the refrigerant compressor 1, the refrigerant having a temperature lower than the reaction temperature is also utilized effectively, so that high COP can be secured.

Also, by condensing the gas generated at the time of decomposition reaction and storing it as a liquid, the capacity required for storage is reduced, and also by utilizing the heat of condensation as heat for evaporating the refrigerant, the refrigerant evaporator 4 for carrying out heat recovery from the atmospheric air is made small in size. Accordingly, the capacity of a fan for supplying the atmospheric air is reduced, so that noise can also be reduced.

Also, by providing the cooling means 13 for recovering heat of condensation on the upstream side of the refrigerant evaporator 4, the condensation of gas generated at the time of decomposition reaction is accelerated due to the low temperature, so that the endothermic reaction in the heating means A 2 is accelerated, and the heat storage density can also be improved.

Further, by utilizing unused energy from the outside of the system, such as solar heat and atmospheric heat, as heat sources for the heating means B 17 for evaporating acetone and heating means C 18 that performs heating utilized for dehydrogenation reaction, high energy efficiency can be realized.

Although the system in which hydrogen and acetone are generated from 2-propanol, which is one example of a heat storage material of the present invention, is used as the reversible reaction for carrying out heat storage, the system is not necessarily limited to this. A system having a large quantity of reaction heat per weight or volume of reactant may be selected to achieve the same effects as those described above.

Also, although atmospheric heat is utilized as the heat sources for the heating means B 17 and the heating means C 18, solar heat, exhaust heat of bath, or heat generated by using a heat pump may be utilized to achieve the same effects as those described above. Further, the configuration may be such that after the operation in the heat storage mode has been finished, the heat pump is operated so that the acetone in the acetone storage vessel 10 and the metal hydroxide in the hydrogen storage vessel 11 are heated via the heating means B 17 and the heating means C 18, and are stored as sensible heat to be utilized when the heat utilization mode is started. In this case as well, the same effects as those described above can be achieved. The heat pump operation is preferably performed in a time zone in which power rates are low (the middle of the night in the present Japanese power system).

(Second Embodiment)

Next, a second embodiment of the present invention will be described.

The second embodiment is basically the same as the first embodiment except for the reaction system. Specifically, the second embodiment differs from the first embodiment in an integrated configuration of the heating means, heat generating means, and the storage vessel of heat storage material, means of recovering heat from the refrigerant having a temperature lower than the reaction temperature and transferring heat to the refrigerant that is going to flow into the compressor, and a heating source used when the heat storage material in a stored state is supplied. Therefore, hereunder, these points are mainly explained.

FIGS. 3, 4, 5 and 6 are schematic views showing operation states in a heat storage mode during the heat pump operation, in a heat storage mode after the finish of heat pump operation, and in a heat utilization mode, and a configuration of a detail portion of an adsorbent storage vessel, respectively, of are generative heat pump system in accordance with the second embodiment of the present invention.

A regenerative heat pump system in the second embodiment includes an adsorbent storage vessel 5, cooling means 13, a heat storage material flow path 14, a valve A 15, heating means B 17, heat generating means 19, a heating medium flow path 20, a water storage vessel 22, a pump 25, a water flow path 26, a reactor vessel heat insulating section 27, and a heat pump cycle. Also, the heat pump cycle is made up of a refrigerant compressor 1, heating means A 2 acting as a refrigerant condenser, a refrigerant expansion valve 3, a refrigerant evaporator 4 that absorbs heat from the atmospheric air to perform an evaporating function, heat exchange means A between refrigerant and water 23, heat exchange means B between refrigerant and water 24, and a refrigerant flow path 8.

Figure 3:
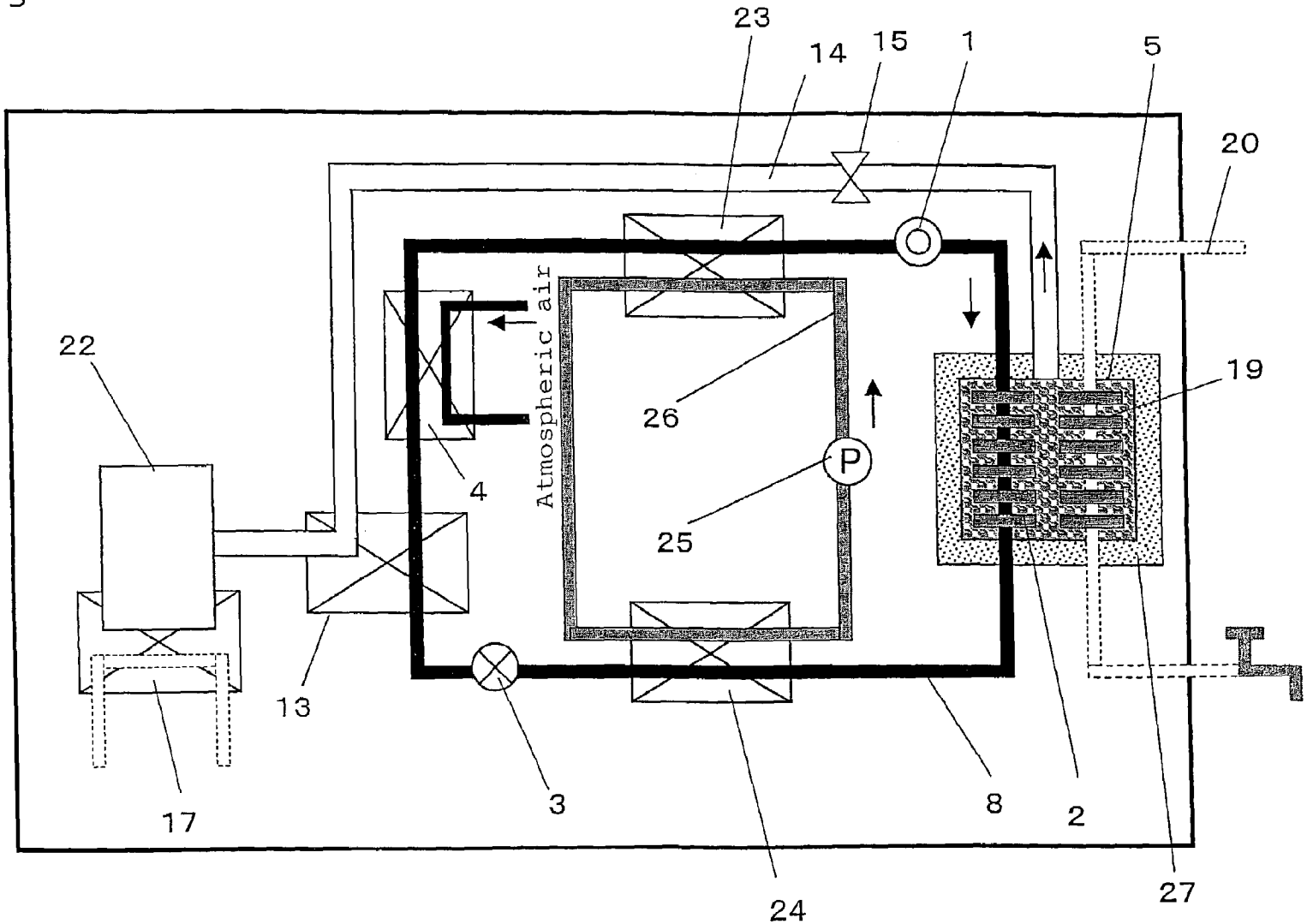
FIG. 3 is a schematic view showing an operation state in a heat storage mode of a regenerative heat pump system in accordance with a second embodiment of the present invention.
Figure 6:
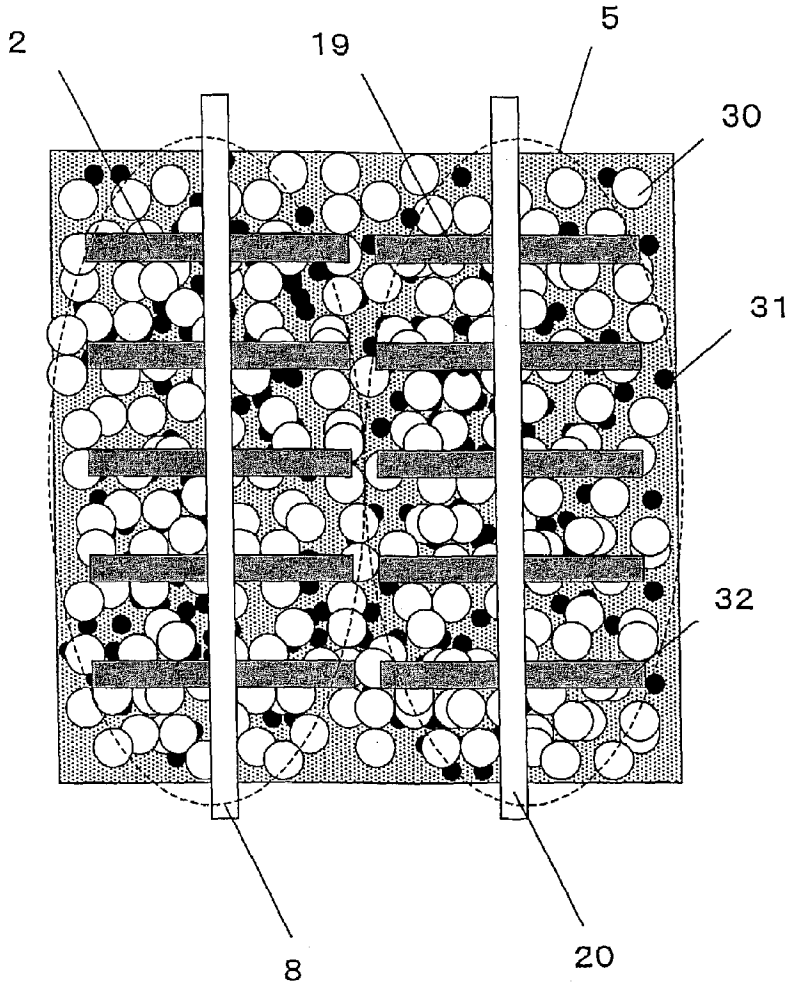
FIG. 6 is a schematic view showing a configuration of a detail portion of a reactor vessel for a regenerative heat pump system in accordance with a second embodiment of the present invention.

First, referring to FIGS. 3, 4 and 6, the operation in a heat storage mode of the regenerative heat pump system in accordance with the second embodiment will be explained. As shown in FIG. 3, when the heat storage mode is started, the operation of heat pump is started. After a refrigerant is evaporated by the heat recovered from the atmospheric air in the refrigerant evaporator 4, the temperature and pressure of the evaporated refrigerant are increased by the refrigerant compressor 1, and heat is transferred from the refrigerant, the temperature and pressure of which have been increased, by the heating means 2 filled with silica gel. The transferred heat is used as a heat absorbing source for dehydration reaction. The endothermic reaction is carried out at a temperature of about 60° C. As shown in FIG. 6, the adsorbent storage vessel 5 is filled with a mixture of silica gel 30 and heat transfer accelerating fibers 31 the diameter of which is smaller than the particle diameter of the silica gel 30 and which consists of copper having high thermal conductivity. This mixture is also packed between heat transfer fins 32 (fin group in contact with the flow path of refrigerant condenser of the heating means 2) and between heat transfer fins 32 of the heat generating means 19 (fin group in contact with the heating medium flow path).

One example of the heat storage material of the present invention corresponds to the silica gel 30 and water, and one example of a high thermal conductivity material of the present invention corresponds to the heat transfer accelerating fiber 31.

Also, the refrigerant heated to about 60° C. after passing through the heating means 2 carries out heat exchange with water in the heat exchange means B between refrigerant and water 24, and, after being cooled to about 30° C., flows into the refrigerant expansion valve 3, thereby being turned into a liquid having a temperature of approximately (atmospheric temperature −5)° C. On the other hand, the heated water is circulated by the pump 25, and in the heat exchange means A between refrigerant and water 23, heat exchange is carried out between the water and the refrigerant that is going to flow into the refrigerant compressor 1. That is to say, by circulating the water by the pump 25, the refrigerant having passed through the heating means 2 is cooled in the heat exchange means B between refrigerant and water 24, and the refrigerant that is going to flow into the refrigerant compressor 1 is heated in the heat exchange means A between refrigerant and water 23.

Further, the valve A 15 is open, so that water vapor generated by the dehydration reaction is discharged from the adsorbent storage vessel 5 as a gas. Subsequently, in the cooling means 13, heat exchange between the water vapor and the refrigerant takes place. The water vapor is condensed, and stored in the water storage vessel 22 as a liquid.

Figure 4:
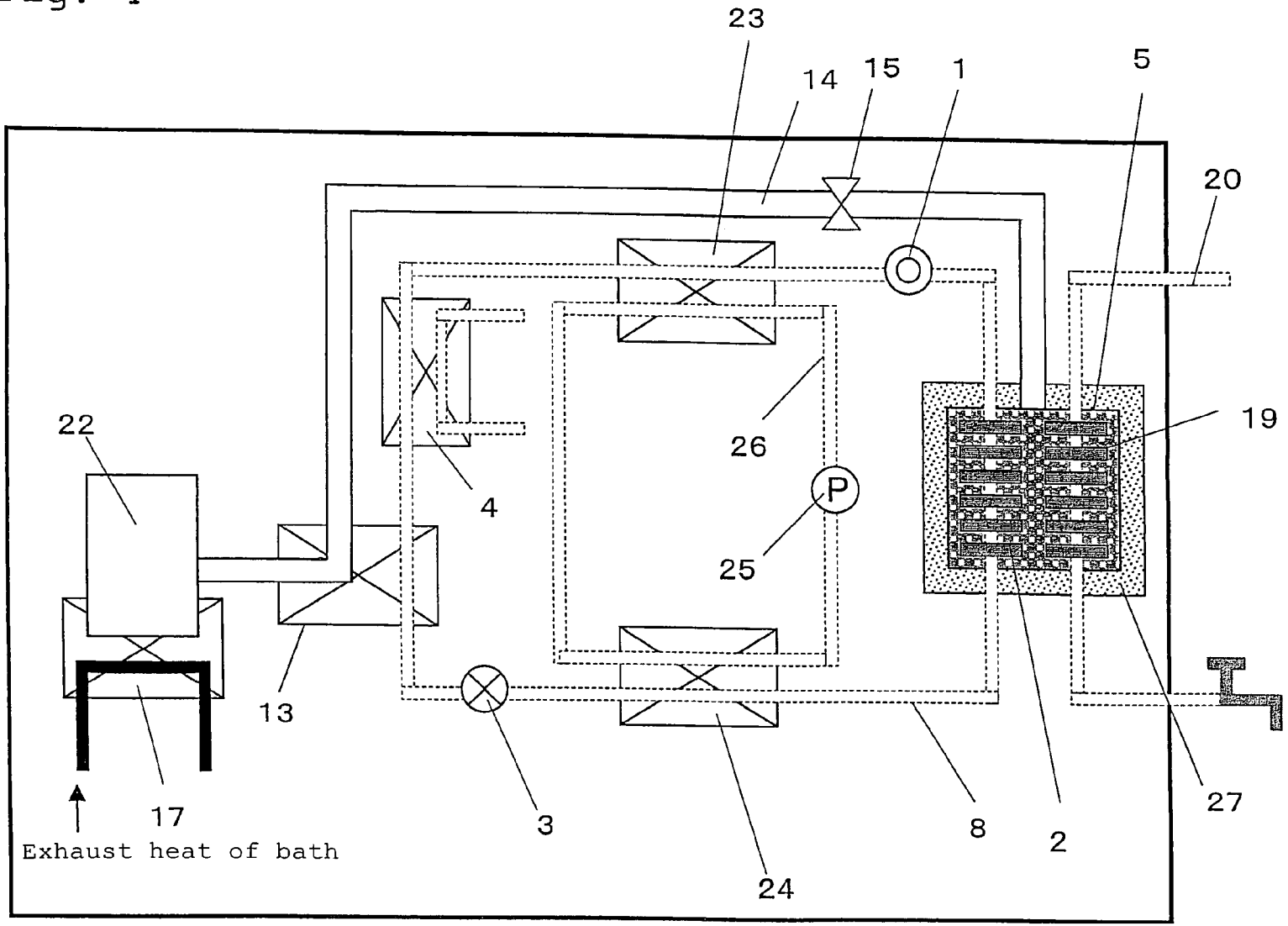
FIG. 4 is a schematic view showing an operation state in a heat storage mode after the finish of heat pump operation of a regenerative heat pump system in accordance with a second embodiment of the present invention.

Subsequently, as shown in FIG. 4, the valve A 15 is closed, and the operation of heat pump is stopped. At this time, the water in the water storage vessel 22 is heated via the heating means B 17 by utilizing exhaust heat from a bath, and stored as sensible heat. Also, the periphery of the adsorbent storage vessel 5 is covered with a heat insulating material having heat conductivity lower than that of the silica gel, so that the adsorbent storage vessel 5 is kept at about 60° C. until the start of operation in a heat utilization mode.

Figure 5:
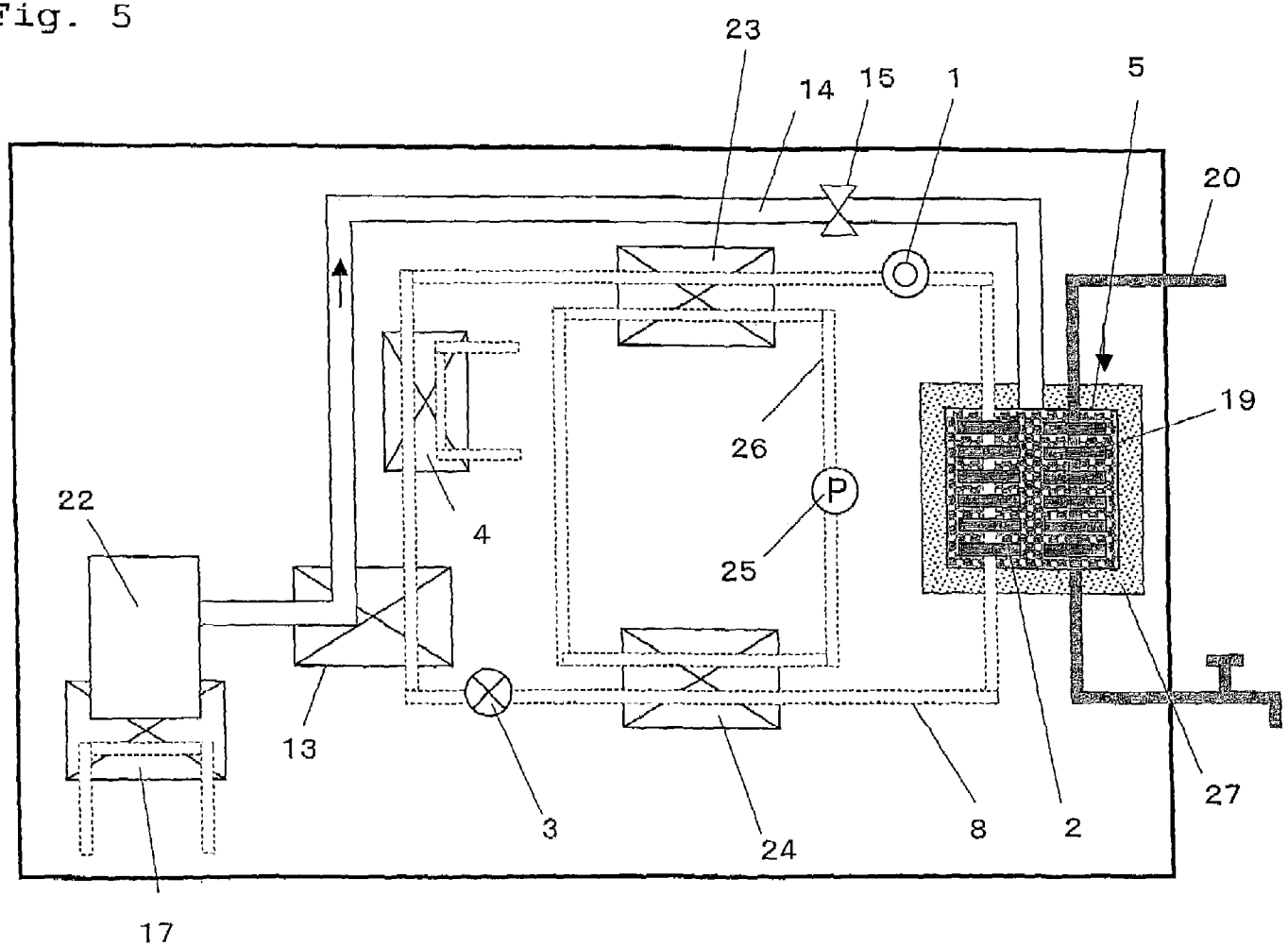
FIG. 5 is a schematic view showing an operation state in a heat utilization mode of a regenerative heat pump system in accordance with a second embodiment of the present invention.

Next, referring to FIG. 5, the operation in a heat utilization mode of the regenerative heat pump system in accordance with the second embodiment will be explained. When the heat utilization mode is started, at the first stage, until the adsorbent storage vessel 5 is heated to about 45° C., water flowing in the heating medium flow path 20 is heated to about 45° C. by utilizing the sensible heat in the heat generating means 19.

Subsequently, when the valve A 15 is opened, since the water storage vessel 22 is beforehand in a decompressed atmosphere, the water in the water storage vessel 22 evaporates by utilizing the sensible heat that the water itself has, and flows into the adsorbent storage vessel 5. In the adsorbent storage vessel 5, exothermic reaction is carried out by the adsorption of the water onto the silica gel, so that the water flowing in the heating medium flow path 20 is heated to about 60° C.

By storing heat output from the heat pump by the adsorption/desorption reaction as described above, a heat storage density as high as 945 kJ/kg (silica gel) can be realized as compared with the conventional heat storage density of 310 kJ/kg (when the temperature is raised to 75° C.) obtained by the sensible heat of water. Therefore, the heat storage section can be made small in size.

Also, by providing means of recovering heat from the refrigerant having a temperature lower than the reaction temperature and transferring heat to the refrigerant that is going to flow into the refrigerant compressor 1, the refrigerant having a temperature lower than the reaction temperature is also utilized effectively, so that high COP can be secured.

Also, by selecting a reaction system capable of carrying out the dehydration reaction and the adsorption reaction in one adsorbent storage vessel 5, the heat storage system can be made simple in construction and small in size.

Also, by condensing a product, which is a gas at the time of dehydration reaction, and storing it as a liquid, the capacity required for storage of the product is reduced, and also by utilizing the heat of condensation as heat for evaporating the refrigerant, the refrigerant evaporator 4 for carrying out heat recovery from the atmospheric air is made small in size. Accordingly, the capacity of a fan for supplying the atmospheric air is reduced, so that noise can also be reduced.

Also, by providing the cooling means 13 for recovering heat of condensation on the upstream side of the refrigerant evaporator 4, the condensation of gas, which is water vapor generated by the dehydration reaction, is accelerated due to the low temperature, so that the endothermic reaction in the heating means 2 is accelerated, and the heat storage density can also be improved.

Also, by charging a mixture of silica gel 30 and heat transfer accelerating fibers 31, the diameter of which is smaller than the particle diameter of the silica gel 30 and which consists of copper having high thermal conductivity, between heat transfer fins 32 of the heating means 2 (fin group in contact with the flow path of refrigerant condenser of the heating means 2) and between heat transfer fins 32 of the heat generating means 19 (fin group in contact with the heating medium flow path), the heat transfer performance from refrigerant to heat storage material and from heat storage material to heating medium is improved, and high thermal efficiency can be obtained.

Also, by heating the water of the heating medium by utilizing the sensible heat in the adsorbent storage vessel 5 immediately after the start of heat utilization mode, the supply of heat can be started in a moment, which provides great convenience.

Further, by utilizing the sensible heat of water in the water storage vessel 22 as a heating source for evaporating water, in the heat utilization mode, the operation can be performed without a driving section, which leads to great quietness. Also, by performing the operation under a reduced pressure lower than the atmospheric pressure, the sensible heat of water in the water storage vessel 22 can be utilized as a heating source of the heating means B 17 to the outside air temperature level, and hence this configuration is effective in effectively using low-temperature exhaust heat. Further, by performing the heat pump operation for storing the sensible heat of water in the water storage vessel 22 in a time zone in which power rates are low (the middle of the night in the present Japanese power system), this system is superior in terms of economy.

One example of the first storage means, which is integrated with heat exchange means between first refrigerant and heat storage material and heating means, of the present invention corresponds, in the second embodiment, to the adsorbent storage vessel 5 integrated with the heating means 2 and the heat generating means 19.

Also, one example of the second storage means of the present invention corresponds to the water storage vessel 22 in the second embodiment.

Also, the heat recovery means of the present invention corresponds to the heat exchange means A between refrigerant and water 23, the heat exchange means B between refrigerant and water 24, the pump 25 for circulating water therebetween, and the water flow path 26.

Although the water adsorption reaction onto an adsorbent is used as the reversible reaction for carrying out heat storage, the system is not necessarily limited to this. A system having a large quantity of reaction heat per weight or volume of reactant may be selected to achieve the same effects as those described above.

Also, although the periphery of the adsorbent storage vessel 5 is covered with the heat insulating material having heat conductivity lower than that of the adsorbing/desorbing material so that the sensible heat in the adsorbent storage vessel 5 kept at the endothermic reaction temperature is utilized immediately after the start of operation in the heat utilization mode, the sensible heat may be utilized by heating the adsorbent storage vessel 5 to further increase the temperature at the final stage of the operation in the heat storage mode, by which the quantity of utilization of sensible heat can be increased as compared with the above-described method.

Also, although the sensible heat of water in the water storage vessel 22 is utilized as the heat source for evaporation, atmospheric heat, solar heat, exhaust heat of bath, or heat generated by using a heat pump may be utilized to achieve the same effects as those described above. Further, although water is used as a medium in this embodiment, if methanol etc. are used as a medium, evaporation can be effected at a lower temperature, and even if the atmospheric heat is used as a heat source, a sufficient output can be obtained even at the time of low outside air temperature.

Also, although the dehydration reaction from silica gel is utilized as the endothermic reaction, and the water absorption reaction is utilized as the exothermic reaction, an ammonia elimination reaction from an ammonia complex of inorganic salts such as calcium chloride, iron chloride, and manganese chloride may be utilized as the endothermic reaction, and an ammonification reaction of inorganic salts may be utilized as the exothermic reaction. In this case, a vapor pressure higher than that of water can be secured at the time of low temperature, so that even when the atmospheric heat is utilized as a heat source, a sufficient output can be obtained even at the time of low outside air temperature.

Further, although silica gel is used as an adsorbent, an inorganic porous material such as zeolite, a carbon-based porous material such as activated carbon, or a water absorbing polymeric material such as polyacrylamide may be used to achieve the same effects as those described above. Also, in order to release water from the adsorbent at a low temperature, activated carbon, silica gel, and polyacrylamide are especially effective.

(Third Embodiment)

Next, a third embodiment will be described.

The third embodiment differs from the second embodiment in a supply source of reaction heat at the time when a heat storage material in a stored state is supplied, and a configuration capable of directly transferring heat from a refrigerant to a heating medium. Therefore, hereunder, these points are mainly explained.

FIGS. 7, 8, 9 and 10 are schematic views showing operation states in a heat storage mode during the heat pump operation, in a heat utilization mode immediately after the start of heat utilization, in a heat utilization mode, and in a heat utilization mode after the heat storage material in a stored state becomes absent, respectively, of a regenerative heat pump system in accordance with the third embodiment of the present invention.

A regenerative heat pump system in the third embodiment includes a hydrogen absorbing alloy storage vessel 21, a hydrogen storage vessel 11, a heat storage flow path 14, a valve A 15, heating means C 18, a heating medium flow path 20, heat exchange means between refrigerant and heating medium 28, heat exchange means between refrigerant and reactor 29, a pump 25, a water flow path 26, and a heat pump cycle. Also, the heat pump cycle is made up of a refrigerant compressor 1, heating means A 2 acting as a refrigerant condenser, a refrigerant expansion valve 3, a refrigerant evaporator 4 that absorbs heat from the atmospheric air to perform an evaporating function, heat exchange means A between refrigerant and water 23, heat exchange means B between refrigerant and water 24, and a refrigerant flow path 8.

Figure 7:
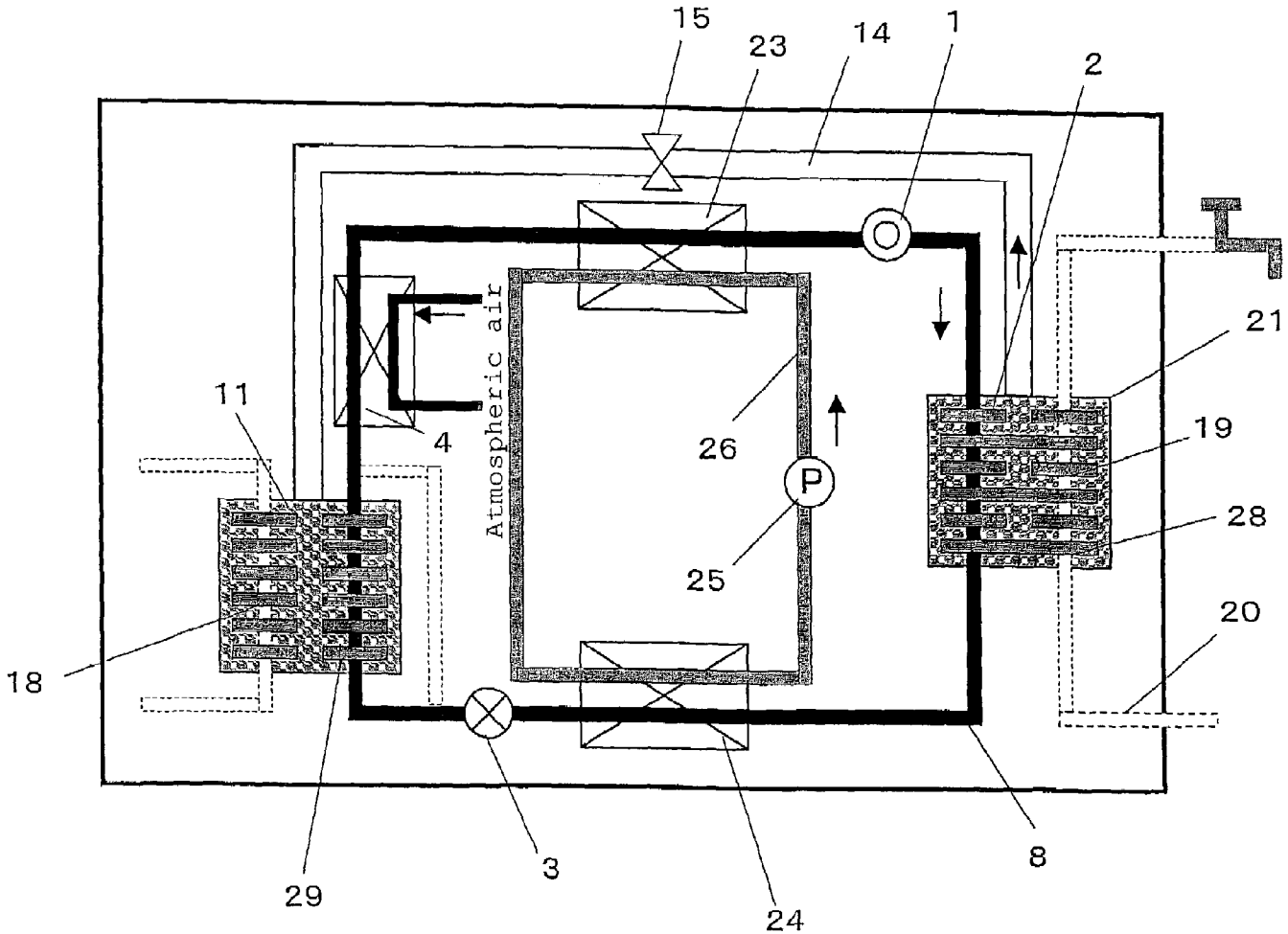
FIG. 7 is a schematic view showing an operation state in a heat storage mode of a regenerative heat pump system in accordance with a third embodiment of the present invention.

First, referring to FIG. 7, the operation in a heat storage mode of the regenerative heat pump system in accordance with the third embodiment will be explained. As shown in FIG. 7, when the heat storage mode is started, the operation of heat pump is started. After a refrigerant is evaporated by the heat recovery from the atmospheric air in the refrigerant evaporator 4, the temperature and pressure of the evaporated refrigerant are increased by the refrigerant compressor 1, and heat is transferred from the refrigerant, the temperature and pressure of which have been increased, by the heating means 2 provided alternately in the hydrogen absorbing alloy storage vessel 21 filled with a hydrogen absorbing alloy. At the same time, heat is also transferred from the heat exchange means between refrigerant and heating medium 28 that is used for heat transfer from refrigerant to hydrogen absorbing alloy and from refrigerant to heating medium. The transferred heat is utilized for dehydrogenation reaction from metal hydroxide in the hydrogen absorbing alloy storage vessel 21. The refrigerant flows in the flow path 8, and the heating means 2 is a fin group in contact with the flow path 8. Also, the flow path 20 is a flow path in which hot water flows at the time of tapping, and the heat exchange means between refrigerant and heating medium 28 is fins in contact with the flow path 8 and the flow path 20. The heating means 2 and the fins of the heat exchange means between refrigerant and heating medium 28 are arranged alternately in the vessel 2. The endothermic reaction is carried out at a temperature of about 60° C.

Also, the refrigerant heated to about 60° C. after passing through the heating means 2 carries out heat exchange with water circulating in the water flow path 26 in the heat exchange means B between refrigerant and water 24, and, after being cooled to about 30° C., flows into the refrigerant expansion valve 3, thereby being turned into a liquid having a temperature of approximately (atmospheric temperature −5)° C. On the other hand, the water heated in the heat exchange means B between refrigerant and water 24 is circulated in the water flow path 26 by the pump 25, and in the heat exchange means A between refrigerant and water 23, heat exchange is carried out between the water and the refrigerant that is going to flow into the refrigerant compressor 1. That is to say, by circulating the water in the water flow path 26 by the pump 25, the refrigerant having passed through the heating means 2 is cooled in the heat exchange means B between refrigerant and water 24, and the refrigerant that is going to flow into the refrigerant compressor 1 is heated in the heat exchange means A between refrigerant and water 23.

Further, the valve A 15 is open, so that the released hydrogen is discharged from the hydrogen absorbing alloy storage vessel 21 as a gas. Subsequently, in the hydrogen storage vessel 11, which is filled with a hydrogen absorbing alloy of a kind different from that packed in the hydrogen absorbing alloy storage vessel 21, a hydrogenation reaction takes place, whereby hydrogen is stored in the hydrogen storage vessel 11. At this time, this reaction heat is transferred to the refrigerant via the heat exchange means between refrigerant and reactor 29.

Next, referring to FIGS. 8, 9 and 10, the operation in a heat utilization mode of the regenerative heat pump system in accordance with the third embodiment will be explained. When the valve A 15 is opened, in the hydrogen storage vessel 11, a dehydrogenation reaction is carried out by utilizing heat recovered from the atmospheric air as a heat sink, so that the hydrogen released from the hydrogen absorbing alloy in the hydrogen storage vessel 11 flows into the hydrogen absorbing alloy storage vessel 21. In the hydrogen absorbing alloy storage vessel 21, an exothermic reaction is carried out by the hydrogenation reaction of hydrogen absorbing alloy. However, this reaction heat is first used to increase the temperature of the hydrogen absorbing alloy in the hydrogen absorbing alloy storage vessel 21, which has heat capacity, and is scarcely used to heat, in a moment, water flowing in the heating medium flow path 20.

Figure 8:
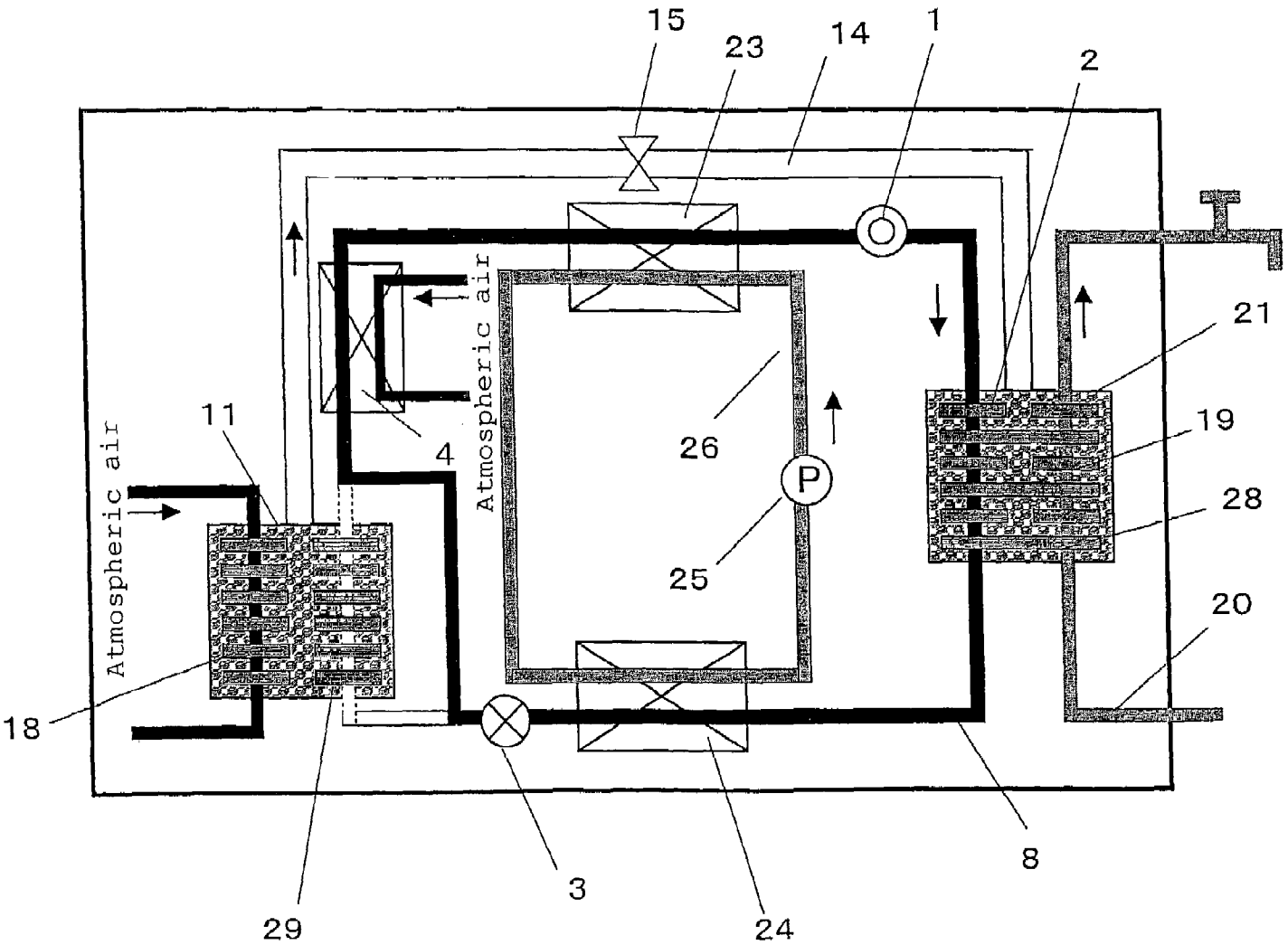
FIG. 8 is a schematic view showing an operation state immediately after the start of a heat utilization mode of a regenerative heat pump system in accordance with a third embodiment of the present invention.

Therefore, as shown in FIG. 8, the heat pump operation is performed at the same time. After the refrigerant is evaporated by the heat recovered from the atmospheric air in the refrigerant evaporator 4, the refrigerant, the temperature and pressure of which have been increased by the refrigerant compressor 1, releases heat in the heat exchange means between refrigerant and heating medium 28. Heat is transferred to the water flowing in the heating medium flow path 20, whereby the heating medium is heated to about 45° C. in a moment.

Figure 9:
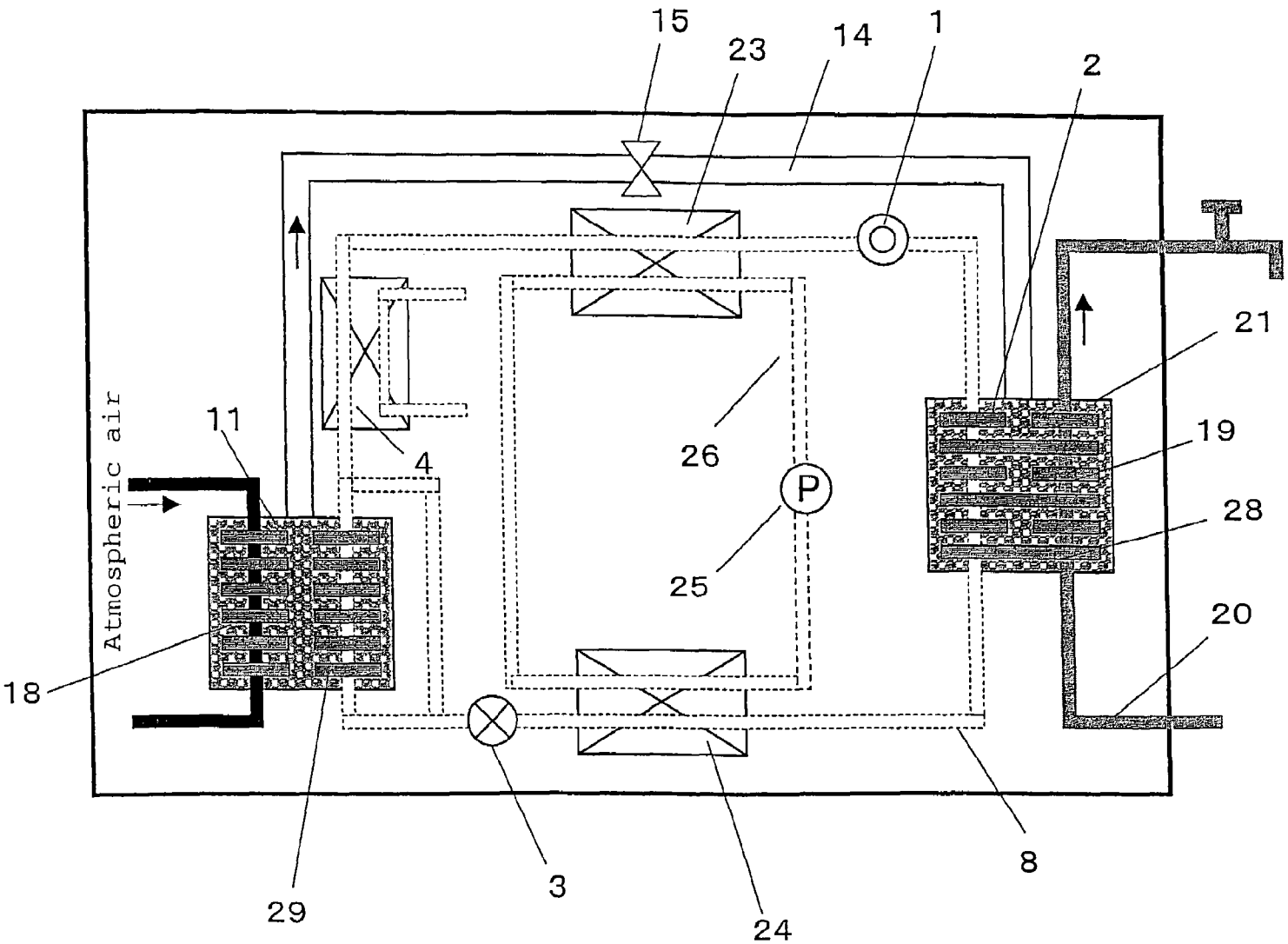
FIG. 9 is a schematic view showing an operation state in a heat utilization mode of a regenerative heat pump system in accordance with a third embodiment of the present invention.

Subsequently, when the hydrogen absorbing alloy in the hydrogen absorbing alloy storage vessel 21 is heated to about 45° C., as shown in FIG. 9, the heat pump operation is ended, and the water flowing in the heating medium flow path 20 is heated to about 45° C. by utilizing heat generated by the hydrogenation reaction of hydrogen absorbing alloy, which is carried out in the endothermic/exothermic reactor 21.

Figure 10:
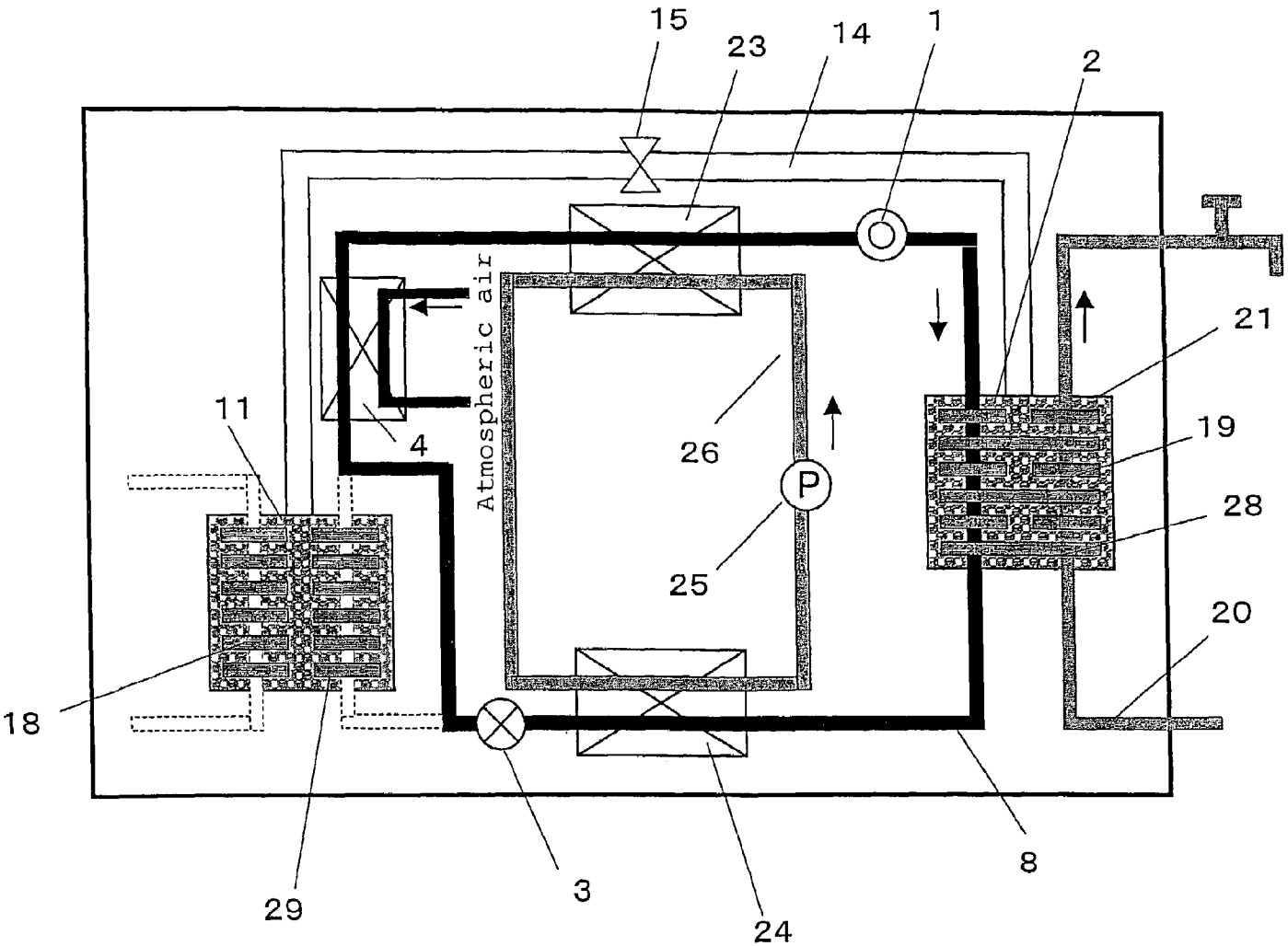
FIG. 10 is a schematic view showing an operation state in a heat utilization mode, in the case where there is a demand for heat greater than the quantity of stored heat, of a regenerative heat pump system in accordance with a third embodiment of the present invention.

Further, in the case where heat demands are high and exceed the quantity of heat stored by the reversible reaction, as shown in FIG. 10, the heat pump operation is performed again. At this time, the heat recovery from the atmospheric air to the hydrogen storage vessel 11 is stopped, and the valve A 15 is also closed. After the refrigerant is evaporated by the heat recovered from the atmospheric air in the refrigerant evaporator 4, the refrigerant, the temperature and pressure of which have been increased by the refrigerant compressor 1, releases heat in the heat exchange means between refrigerant and heating medium 28. Heat is transferred to the water flowing in the heating medium flow path 20, whereby the heating medium is heated to about 45° C.

By storing heat output from the heat pump by the reversible reaction as described above, a heat storage density as high as 900 kJ/L (hydrogen absorbing alloy) can be realized as compared with the conventional heat storage density of 310 kJ/L (when the temperature is raised to 75° C.) obtained by the sensible heat of water. Therefore, the heat storage system can be made small in size.

Also, by providing means of recovering heat from the refrigerant having a temperature lower than the reaction temperature and transferring heat to the refrigerant that is going to flow into the refrigerant compressor 1, the refrigerant having a temperature lower than the reaction temperature is also utilized effectively, so that high COP can be secured.

Also, by selecting a reaction system capable of carrying out the elimination reaction and the adsorption reaction in one hydrogen absorbing alloy storage vessel 21, the heat storage system can be made simple in construction and small in size.

Also, by forming a compound or adsorbent, which is stored as a solid, from the released gas, the capacity required for storage is reduced, and also by utilizing the heat of reaction as heat for evaporating the refrigerant, the refrigerant evaporator 4 for carrying out heat recovery from the atmospheric air is made small in size. Accordingly, the capacity of a fan for supplying the atmospheric air is reduced, so that noise can also be reduced.

Also, by integrating the hydrogen storage vessel 11 for storing the released gas with the heat exchange means between refrigerant and reactor 29 for transferring heat to the refrigerant, a compact heat storage section can be realized.

Also, by utilizing energy from the outside of the system, such as solar heat and atmospheric heat, as heat sources for the heating means C 18 that performs heating utilized for dehydrogenation reaction, high energy efficiency can be realized.

Further, by the configuration capable of directly transferring heat from the refrigerant to the heating medium, heating can be started in a moment in the heat utilization mode. Also, even in the case where heat demands are high and exceed the quantity of heat stored by the reversible reaction, the quantity of heat can be secured by the direct heat transfer from the refrigerant to the heating medium using the heat pump cycle, so that heat can be supplied stably.

Although the hydrogenation reaction with the hydrogen absorbing alloy is used as the reversible reaction for carrying out heat storage, the system is not necessarily limited to this. A system having a large quantity of reaction heat per weight or volume of reactant may be selected to achieve the same effects as those described above.

One example of the first storage means, which is integrated with the heat exchange means between first refrigerant and heat storage material and the heating means, of the present invention corresponds, in the third embodiment, to the hydrogen absorbing alloy storage vessel 21 integrated with the heating means 2 and heat generating means 19.

One example of the second storage means, which is integrated with the heat exchange means between second refrigerant and heat storage material, of the present invention corresponds, in the third embodiment, to the hydrogen storage vessel 11 integrated with the heat exchange means between refrigerant and reactor.

Also, the fact that a plurality of fins provided on the outside surface of the refrigerant flow path of the present invention and at least some of a plurality of heat transfer fins provided on the outside surface of the heating medium flow path are common to each other corresponds, in the third embodiment, to the heat exchange means between refrigerant and heating medium 28 in which the fins of the heating means A 2 and the fins of the heat generating means 19 are common to each other and heat can be transferred between the refrigerant and the heating medium.

Also, although the atmospheric heat is utilized as the heat source for dehydrogenation reaction, solar heat, exhaust heat of bath, or heat generated by using a heat pump may be utilized to achieve the same effects as those described above. At this time, in this embodiment, a sufficient output can be obtained even at the time of low outside air temperature even in the case where the atmospheric heat is especially used, as compared with the case where water is used as a medium.

Also, the configuration may be such that after the operation in the heat storage mode has been finished, the heat pump is operated so that the metal hydroxide in the hydrogen storage vessel 11 is heated via the heating means B 17 and the heating means C 18, and is stored as sensible heat. In this case as well, the same effects as those described above can be achieved. The heat pump operation is preferably performed in a time zone in which power rates are low (the middle of the night in the present Japanese power system).

Further, although the hydrogen absorbing alloy is used as a hydrogen storage material, a carbon-based material may be used to achieve the same effects as those described above. As the hydrogen absorbing alloy, an alloy consisting of La, Mm, Mg, Ti, Fe, Ca, V, and the like is used.

In the above-described three embodiments, the configuration is such that the heat stored by chemical reactions is output via water. However, the configuration is not limited to this. For example, air may be used as the heating medium to use the system in applications such as heating and drying. In this case as well, the same effects as those described above can be achieved.

The regenerative heat pump system in accordance with the present invention achieves space saving or higher energy efficiency while ensuring reliability, and therefore is useful, for example, as a household heating and hot water supply system. Also, this heat pump system can be applied to an industrial heating apparatus and the like.

What is claimed is:

1. A regenerative heat pump system comprising:

a heat pump cycle having a compressor, a radiator for a refrigerant, an expansion valve, a evaporator for the refrigerant, and a refrigerant flow path;

first storage means of storing a heat storage material;

heat exchange means between first refrigerant and heat storage material of heating said heat storage material by heat transferred from said refrigerant so that said heat storage material is decomposed or some thereof is separated;

heat exchange means between second refrigerant and heat storage material of transferring heat from at least one kind of said decomposed or separated heat storage material to said refrigerant;

second storage means of storing at least one kind of said decomposed or separated heat storage material; and heat generating means of generating heat to heat a heating medium by recombining said heat storage material having been stored in said second storage means, wherein said heat exchange means between first refrigerant and heat storage material is also used as said radiator of the heat pump cycle, and heat exchange means between second refrigerant and heat storage material is also used as at least a part of said evaporator of the heat pump cycle.

2. The regenerative heat pump system according to claim 1, wherein said first storage means is integrated with said heat exchange means between first refrigerant and heat storage material and said heat generating means.

3. The regenerative heat pump system according to claim 1, wherein said second storage means is integrated with said heat exchange means between second refrigerant and heat storage material.

4. The regenerative heat pump system according to claim 3, wherein said second storage means has a storage material for occluding or adsorbing at least one kind of gas of said decomposed or separated heat storage material, and at the time of heat storage operation, said gas is stored in said second storage means by forming a compound or a complex with said storage material, and the heat generated at the time of formation of said complex is transferred to said refrigerant.

5. The regenerative heat pump system according to claim 1, wherein at the time of heat storage operation, at least one kind of gas of said decomposed or separated heat storage material is cooled by said heat exchange means between second refrigerant and heat storage material, and stored in said second storage means as a liquid.

6. The regenerative heat pump system according to claim 5, wherein said gas is a first gas;

said regenerative heat pump system further comprises a third storage means having a storage material for occluding or adsorbing a second gas generated by the decomposition of said heat storage material, other than said first gas; and at the time of heat storage operation, said second gas is stored in said third storage means by forming a compound or a complex with said storage material.

7. The regenerative heat pump system according to claim 1, wherein said second storage means has a storage material for occluding or adsorbing at least one kind of gas of said separated heat storage material;

at the time of heat storage operation, said gas is stored in said second storage means by forming a compound or a complex with said storage material.

8. The regenerative heat pump system according to claim 5, wherein said storage material is water and water adsorbing material; and said gas is water vapor.

9. The regenerative heat pump system according to claim 6, wherein said heat storage material is 2-propanol;

said first gas is acetone; and said second gas is hydrogen.

10. The regenerative heat pump system according to claim 7, wherein said heat storage material is a hydrogen or a hydrogen occluding material for occluding hydrogen; and said gas is hydrogen.

11. The regenerative heat pump system according to claim 1, wherein said heat exchange means between second refrigerant and heat storage material is arranged on the most upstream side of said evaporator of the cycle.

12. The regenerative heat pump system according to claim 1, wherein said regenerative heat pump system further comprises heat recovery means of recovering heat from the refrigerant flowing between said radiator for the refrigerant and said expansion valve, and of transferring heat to the refrigerant flowing between said cooling means and said compressor.

13. The regenerative heat pump system according to claim 2, wherein said regenerative heat pump system further comprises a heating medium flow path in which said heating medium flows;

said heat exchange means between first refrigerant and heat storage material has a plurality of heat transfer fins provided on the outside surface of said refrigerant flow path;

said heat generating means has a plurality of heat transfer fins provided on the outside surface of said heating medium flow path, and said heat storage material is packed between said plurality of heat transfer fins provided on the outside surfaces of said refrigerant flow path and said heating medium flow path.

14. The regenerative heat pump system according to claim 13, wherein said heat storage material is of a spherical or pellet shape; and said first storage means has a high thermal conductivity material, which has higher thermal conductivity and a smaller diameter than said heat storage material and is mixed with said heat storage material, between said plurality of heat transfer fins.

15. The regenerative heat pump system according to claim 13, wherein said first storage means has a highly heat insulating material having lower thermal conductivity than said heat storage material on the outside surface; and at the time of heat utilization operation, said heating medium is heated by utilizing heat of said heat storage material.

16. The regenerative heat pump system according to claim 15, wherein the operation of said heat pump cycle is performed continuously even after the finish of heat storage operation to raise the temperature of said heat storage material.

17. The regenerative heat pump system according to claim 13, wherein at least some of said plurality of heat transfer fins provided on the outside surface of said refrigerant flow path and said plurality of heat transfer fins provided on the outside surface of said heating medium flow path are common to each other.

18. The regenerative heat pump system according to claim 17, wherein at the time of start of heat utilization operation, heat released from said radiator is directly transferred to said heating medium via said heat transfer fins by performing the operation of said heat pump cycle.

19. The regenerative heat pump system according to claim 17, wherein at the time of heat utilization operation, the operation of said heat pump cycle is performed by detecting that one kind of said decomposed or separated heat storage material, which is stored in said second storage means, becomes absent, so as to cause the heat released from said radiator to be directly transferred to said heating medium via said heat transfer fins.

20. The regenerative heat pump system according to claim 1, wherein said second storage means has heating means using solar heat, atmospheric heat, exhaust heat of city water or bath, or heat released from said heat pump cycle as a heat source; and at the time of heat utilization operation, one kind of said decomposed or separated heat storage material, which is stored in said second storage means, is heated and supplied to said heat generating means.

21. The regenerative heat pump system according to claim 1, wherein said second storage means has heating means using solar heat, atmospheric heat, exhaust heat of city water or bath, or heat released from said cycle as a heat source;

at the time of finish of heat storage operation, said second storage means is heated so that heat is stored in one kind of said decomposed or separated heat storage material, which is stored in said second storage means, as sensible heat; and at the time of heat utilization operation, one kind of said heat storage material stored in said second storage means is supplied to said heat generating means with said sensible heat being used as a heat source.

22. The regenerative heat pump system according to claim 21, wherein electric power in a time zone in which power rates are low is used for the operation of said cycle.

* * * * *